US011217197B2

(12) United States Patent
Liu et al.

(10) Patent No.: US 11,217,197 B2
(45) Date of Patent: Jan. 4, 2022

(54) DATA DRIVING METHOD BASED ON CHARGE SHARING TIMING TABLE

(71) Applicant: Xianyang Caihong Optoelectronics Technology Co., Ltd, Xianyang (CN)

(72) Inventors: Zihan Liu, Xianyang (CN); Youye Chen, Xianyang (CN)

(73) Assignee: XIANYANG CAIHONG OPTOELECTRONICS TECHNOLOGY CO., LTD, Xianyang (CN)

( * ) Notice: Subject to any disclaimer, the term of this patent is extended or adjusted under 35 U.S.C. 154(b) by 109 days.

(21) Appl. No.: 16/730,022

(22) Filed: Dec. 30, 2019

(65) Prior Publication Data

US 2020/0219461 A1 Jul. 9, 2020

(30) Foreign Application Priority Data

Jan. 7, 2019 (CN) ..... 201910012972.5

(51) Int. Cl.
*G09G 3/36* (2006.01)
*G09G 5/00* (2006.01)

(52) U.S. Cl.
CPC ..... *G09G 3/3688* (2013.01); *G09G 2310/08* (2013.01)

(58) Field of Classification Search
CPC .. G09G 3/00; G09G 3/20; G09G 3/36; G09G 5/00; G09G 5/10; G06F 3/038
See application file for complete search history.

(56) References Cited

U.S. PATENT DOCUMENTS

2012/0133847 A1* 5/2012 Moon ..... G09G 3/3611 348/790
2018/0190220 A1* 7/2018 Yu ..... G09G 3/3614
2018/0286344 A1* 10/2018 Yang ..... G09G 5/18
2019/0096304 A1* 3/2019 Hu ..... G09G 3/20

* cited by examiner

*Primary Examiner* — Chanh D Nguyen
*Assistant Examiner* — Nguyen H Truong
(74) *Attorney, Agent, or Firm* — WPAT, PC

(57) ABSTRACT

A data driving method and a data driving device are provided. The data driving method includes: transmitting a charge sharing signal for a current data line according to a pre-stored charge sharing timing table; transmitting a valid display data for the current data line; and executing the charge sharing signal to complete a charge sharing between signal channels. The data driving device includes a timing controller, a transmission interface, a source driver, a plurality of data lines, and a charge sharing switch. The data driving method and the data driving device of the disclosure can separately set the charge sharing signal for each row by setting the charge sharing signal on each row of the valid display data through the pre-stored charge sharing timing table. This achieves independent control of charge sharing per line during display.

5 Claims, 4 Drawing Sheets

DATA DRIVING METHOD BASED ON CHARGE SHARING TIMING TABLE

FIELD OF THE DISCLOSURE

The disclosure relates to the field of display technologies, and more particularly to a data driving method and a data driving device.

BACKGROUND OF THE DISCLOSURE

With the improvement of semiconductor technology, the liquid crystal display has the advantages of low power consumption, light weight, high resolution, high color saturation, and long life. Therefore, it is widely used in computer and mobile phone LCD screens and LCD TVs and other electronic products that are closely related to life.

When the display panel of the liquid crystal display displays the driving signal, the polarity of the voltage generally applied to the liquid crystal capacitor of each pixel is reversed at a certain time interval, thereby avoiding polarization of the liquid crystal material and causing permanent damage. When the voltage polarity of the driving display panel starts to reverse, the driving circuit consumes the largest current, so charge sharing technology is usually used to reduce power consumption.

The prior art charge sharing technique is to output a signal channel to the display panel, and set a switch between the odd data channel and the even data channel. By controlling the on and off of the switch, the odd and even channels are shorted before the output signal switches between positive and negative, so that the charge is evenly distributed, thereby reducing the current consumption of the entire drive circuit. After the positive and negative cancellation, the initial potential of each channel drops or rises to the vicinity of the common voltage, so that the voltage swing of the display signal during driving can be reduced, and the power consumption when the polarity is reversed can be saved.

However, the current popular charge sharing switch control method is to set a charge sharing instruction in the configuration information of each frame of data and the interface external to the printed circuit board. This control method is limited to the overall setting of one frame, and the charge sharing control cannot be performed separately for the input signal line by line.

SUMMARY OF THE DISCLOSURE

In order to solve the above problems existing in the prior art, the disclosure provides a data driving method and a data driving device. The technical problem to be solved by the disclosure is achieved by the following technical solutions:

One aspect of the disclosure provides a data driving method, including:

transmitting a charge sharing signal for a current data line according to a pre-stored charge sharing timing table;

transmitting a valid display data for the current data line; and executing the charge sharing signal to complete a charge sharing between signal channels.

In an embodiment of the disclosure, before transmitting a charge sharing signal for a current data line according to a pre-stored charge sharing timing table, the data driving method further includes:

transmitting a reset signal to reset all signals for a previous data line.

In an embodiment of the disclosure, before transmitting a charge sharing signal for a current data line according to a pre-stored charge sharing timing table, the data driving method further includes:

transmitting a polarity inversion signal for the current data line.

In an embodiment of the disclosure, the transmitting a charge sharing signal for a current data line according to a pre-stored charge sharing timing table includes:

reading the charge sharing signal for the current data line from the charge sharing timing table; and transmitting the charge sharing signal to a source driver through a mini LVDS differential interface.

In an embodiment of the disclosure, the transmitting a valid display data for the current data line includes:

transmitting the valid display data to the source driver through the mini LVDS differential interface; and transmitting the valid display data to a display panel through the source driver.

In an embodiment of the disclosure, the executing the charge sharing signal to complete a charge sharing between signal channels includes:

turning on or off a corresponding charge sharing switch according to the charge sharing signal, before the valid display data being switched in polarity between positive and negative polarities.

In an embodiment of the disclosure, the transmitting a reset signal to reset all signals of a previous data line includes:

transmitting the reset signal to the source driver through the mini LVDS differential interface, after the valid display data is executed;

storing the valid display data for the current data line according to the reset signal; and resetting a corresponding charge sharing switch according to the reset signal.

Another embodiment of the disclosure provides a data driving device including a timing controller, a transmission interface, a source driver, a plurality of data lines, and a charge sharing switch, wherein the timing controller is configured (i.e., structured and arranged) to store a plurality of valid display data and a plurality of charge sharing instructions;

the transmission interface is configured to transmit the plurality of valid display data and the plurality of charge sharing instructions to the source driver;

the plurality of data lines are configured to transmit the plurality of valid display data to respective pixel units of the display panel;

the source driver is configured to control the display panel display image according to the plurality of valid display data, and control ON-OFF states of the charge sharing switches according to the plurality of charge sharing instructions; and the charge sharing switches each are connected to designated ones of the plurality of data lines, and configured to be turned on or off according to the plurality of charge sharing instructions to carry out a charge sharing between the designated ones of the plurality of data lines.

In an embodiment of the disclosure, the timing controller is provided with a charge sharing timing table therein, and the charge sharing timing table is configured to set and store the plurality of charge sharing instructions.

In an embodiment of the disclosure, the transmission interface is configured to perform transmissions of the valid display data and the charge sharing instruction according to a mini LVDS protocol.

In an embodiment of the disclosure, the timing controller is further provided with a polarity inversion timing table for setting a polarity inversion signal;

the polarity inversion signal is configured to be transmitted to the source driver through the transmission interface.

Compared with the prior art, the beneficial effects of the disclosure are:

1. The data driving method and the data driving device of the disclosure can separately set a charge sharing signal for each row by setting a charge sharing signal on each row of valid display data through a pre-stored charge sharing timing table. This achieves independent control of charge sharing per line during display.

2. The data driving method and the data driving device of the disclosure use the differential signal of the mini LVDS interface to transmit the charge sharing signal and the valid display signal, instead of a plurality of pins for transmitting the charge sharing signal disposed on the printed circuit board, thereby reducing the layout area of the printed circuit board.

3. The polarity inversion signal of the disclosure can also be transmitted by using the differential signal of the mini LVDS interface, instead of a plurality of pins for transmitting polarity inversion quotation marks disposed on the printed circuit board. Thereby the layout area of the printed circuit board is further reduced.

The above description is merely an overview of the technical solutions of the disclosure, and can be implemented in accordance with the contents of the specification in order to more clearly understand the technical means of the disclosure. The above and other objects, features, and advantages of the disclosure will become more apparent and understood.

DETAILED DESCRIPTION OF EMBODIMENTS

The data driving method and the data driving device according to the disclosure will be described in detail below in conjunction with the accompanying drawings and specific embodiments in order to further illustrate the technical means and functions of the disclosure.

The above and other technical contents, features, and advantages of the disclosure will be apparent from the following detailed description of the embodiments. Through the description of the specific embodiments, the technical means and effects of the disclosure for achieving the intended purpose can be further and specifically understood. The accompanying drawings are only for the purpose of illustration and description, and are not intended to limit the disclosure.

Embodiment 1

Figure 3:
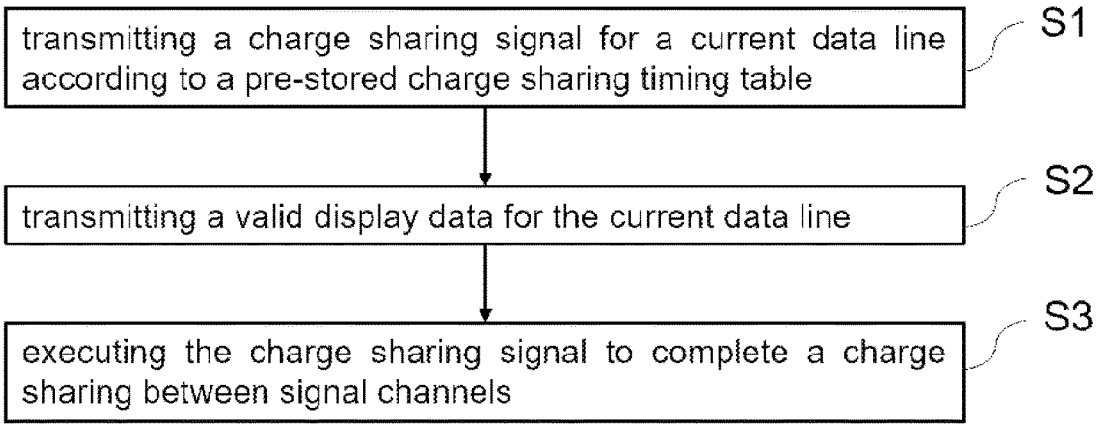
FIG. 3 is a flowchart of a data driving method according to an embodiment of the disclosure.

See FIG. 3, FIG. 3 is a flowchart of a data driving method according to an embodiment of the disclosure.

The data driving method of this embodiment includes:

S1: transmitting a charge sharing signal for a current data line according to a pre-stored charge sharing timing table;

S2: transmitting a valid display data for the current data line; and

S3: executing the charge sharing signal to complete a charge sharing between signal channels.

Figure 1:
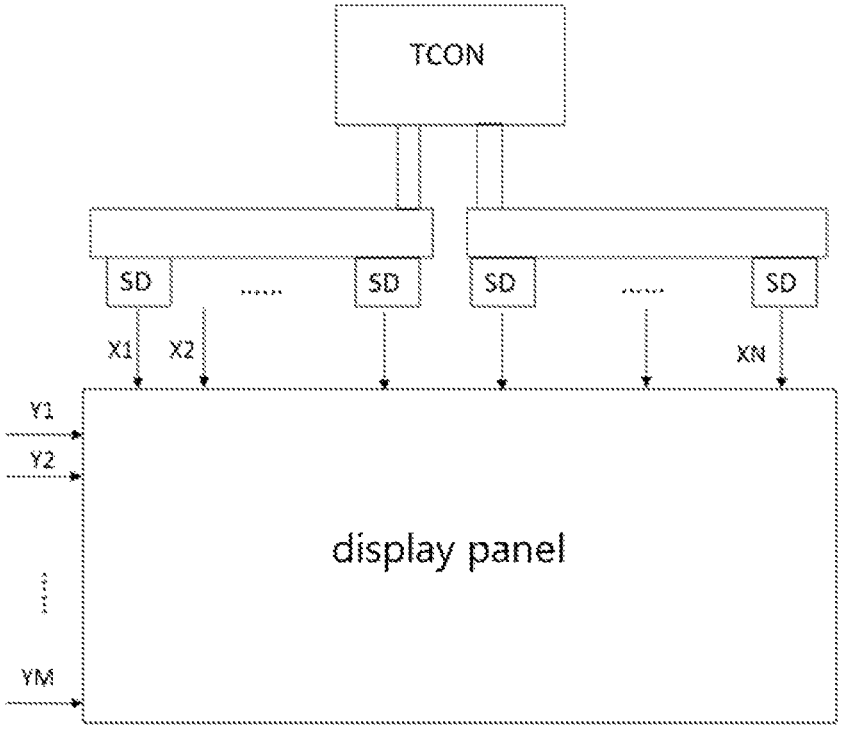
FIG. 1 is a schematic structural diagram of a display device according to an embodiment of the disclosure.

Further, step S1 includes:

S11: reading the charge sharing signal for the current data line from the charge sharing timing table;

See FIG. 1, FIG. 1 is a schematic structural diagram of a display device according to an embodiment of the disclosure. The display device usually includes a timing controller (TCON), a source driver (SD), a gate driver (GD), N data lines X1, X2, . . . , XN and M gate lines Y1, Y2, . . . , YM, and a display panel. Wherein the main function of the timing controller (TCON) is to process each frame of image data, and generate data signals and control signals corresponding to each frame of image data. The control signal includes an output enable signal (OE1) for controlling the gate driver output gate signal, and the gate signal is transmitted to the display panel through the scan gate lines Y1, Y2, . . . , YM. When the output enable signal (OE1) is high, the gate signal is low, and when the output enable signal (OE1) is low, the gate signal is high. When the data signal is transmitted to the source driver, the source driver converts the received data signal into a data voltage and writes the corresponding pixel on the display panel through the data lines X1, X2, . . . , XN.

During the data transmission process, N numbers of valid display data are stored during each enable period (Time required to scan one of the gate lines Y1, Y2, . . . , YM), and each valid display data is composed of Q bits. Generally, in the same frame picture, the data signals sent by the double data lines X2, X4, . . . , XN (assuming N is an even number) have different polarities from the data signals sent by the singular data lines X1, X3, . . . , XN−1. For example, if the data signals sent by the double data lines X2, X4, . . . , XN have positive polarity (relative to the common potential), the data signals sent by the singular data lines X1, X3, . . . , XN−1 have negative polarity, and vice versa. Therefore, charge sharing between data lines having opposite polarities is required before each polarity inversion to reduce energy consumption.

Figure 2:
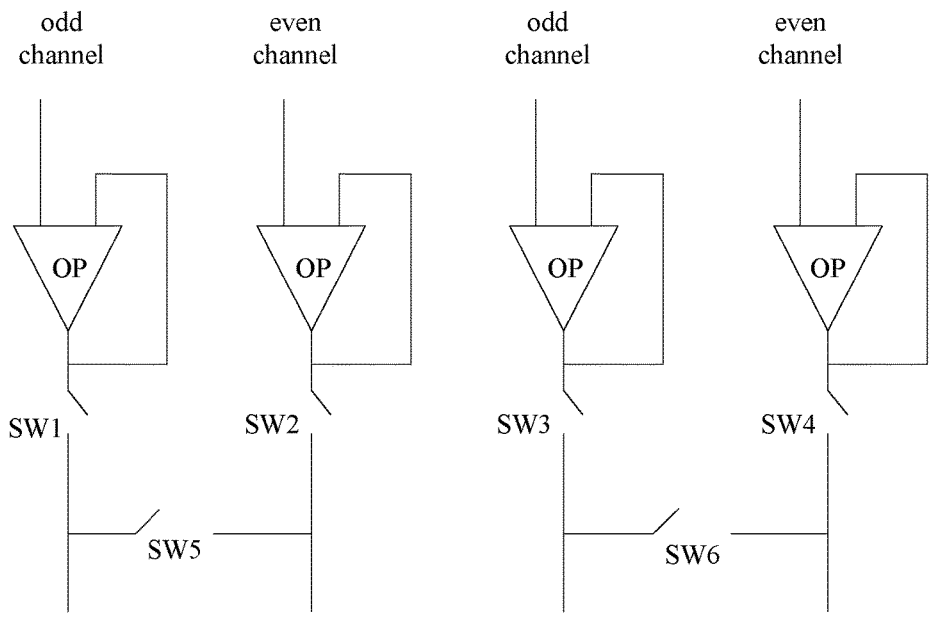
FIG. 2 is a schematic structural view of charge sharing switches.

See FIG. 2, FIG. 2 is a schematic structural view of a charge sharing switch. The working principle of the charge sharing switch is illustrated by taking the four data lines shown in FIG. 1 as an example. Specifically, in FIG. 2, the OP is an amplifier. When the output is normal, the switches SW1, SW2, SW3, and SW4 all are turned on, but the switches SW5 are turned off, data signals are outputted to the display panel; when the voltage polarity is reversed, the switches SW1 to SW5 all are turned on, and odd channels are short-circuited with respective even channels to achieve charge sharing.

In the present embodiment, charge sharing is completed in a preset time by presetting the timing control signal for controlling the charge sharing switch in a charge sharing timing table. The two charge sharing switches SW5 are simultaneously controlled to open and close. At this time, only one bit is needed to store the charge sharing data. Please refer to Table 1. Table 1 is a charge sharing timing table of the charge sharing circuit of FIG. 1, wherein a value of 0 represents an instruction to turn off the charge sharing switch SW5, and a value of 1 represents an instruction to turn on the charge sharing switch SW5. In this embodiment, the charge sharing timing table is stored in a timing controller.

TABLE 1

| Charge sharing timing table | |
|---|---|
| Bit | States of SW |
| 0 | SW5 OFF |
| 1 | SW5 ON |

S12: transmitting the charge sharing signal to the source driver through a mini LVDS differential interface.

Specifically, the mini LVDS differential interface is an interface protocol of the display panel that connects the timing controller to the source driver and is typically used to transmit valid display data. In this embodiment, the 1-bit data of the charge sharing signal is also transmitted from the charge sharing timing table located in the timing controller through the mini LVDS differential interface and temporarily stored to the source driver for subsequent use.

Further, step S2 includes:

S21: transmitting the valid display data to the source driver through the mini LVDS differential interface;

S22: transmitting the valid display data to a display panel through the source driver.

Similar to the charge sharing signal, the valid display data is also transmitted through the mini LVDS differential interface based on the timing control signal.

Further, step S3 includes:

Before the valid display data being switched in polarity between positive and negative polarities, the corresponding charge sharing switch is turned on or off according to the charge sharing signal. Specifically, after the normal display in step S2 is performed, the source driver controls the charge sharing switch to be turned on according to the temporarily stored charge sharing signal, so that the data lines having opposite polarities are short-circuited, and the charges are evenly distributed.

Further, after step S3, the method further includes:

S4: transmitting a reset signal to reset all signals for the previous data line.

Specifically, after the valid display data is executed, transmitting a reset signal to the source driver through the mini LVDS differential interface; storing the valid display data for the current data line according to the reset signal; and resetting the charge sharing switch according to the reset signal.

Figure 4:
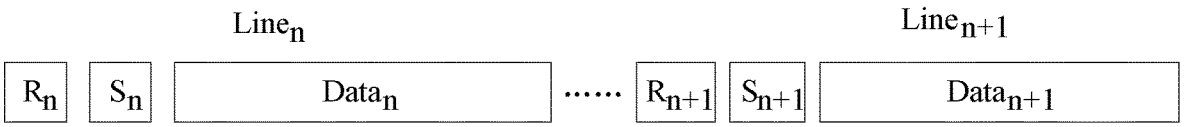
FIG. 4 is a timing diagram of a control signal according to an embodiment of the disclosure.

See FIG. 4, FIG. 4 is a timing diagram of a control signal according to an embodiment of the disclosure. As shown, before the charge sharing signal $S_n$ of the current data line $Line_n$ is transmitted according to the pre-stored charge sharing timing table, the reset signal $R_n$ is transmitted to reset all signals of the previous data line. After transmitting the charge sharing signal $S_n$ of the current data line $Line_n$ according to the pre-stored charge sharing timing table, the valid display data $Data_n$ of the current data line is transmitted to the source driver through the mini LVDS differential interface and temporarily stored in the source driver. When the polarity of the voltage on the data line is inverted, the source driver controls the charge sharing switch according to the charge sharing signal Sn.

After all the data transmission of $Line_n$ is completed, after a certain field blanking area is passed, the data information of the next data line $Line_{n+1}$ is repeatedly transmitted. Specifically, the reset signal $R_{n+1}$ is first transmitted to the source driver through the mini LVDS differential interface, and the reset signal $R_{n+1}$ is used to reset all signals of the data line $Line_n$, including resetting the charge sharing switch; the charge sharing signal $S_{n+1}$ is then transmitted to the source driver through the mini LVDS differential interface; the valid display signal $Data_{n+1}$ is transmitted to the source driver through the mini LVDS differential interface, and after the transmission of the valid display signal $Data_{n+1}$ is completed, a charge sharing instruction is executed to control the charge sharing switch. The transmission process is repeated until all information transmission of each data line in the current frame ends, and the source driver controls the display panel to perform screen display according to the valid display data of all the data lines.

The data driving method of the embodiment uses the differential signal of the mini LVDS interface to transmit the charge sharing signal and the valid display signal, instead of the plurality of pins for transmitting the charge sharing signal disposed on the printed circuit board, thereby reducing the layout area of the printed circuit board.

Embodiment 2

Figure 5:
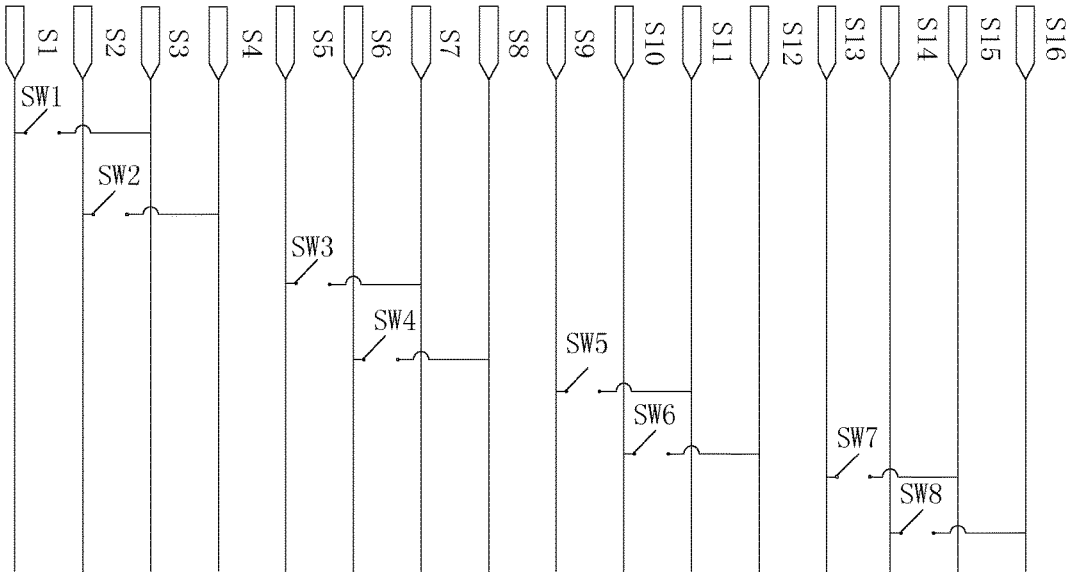
FIG. 5 is a schematic structural view of another type of charge sharing switches.

Based on the above embodiment, the present embodiment exemplarily describes a data driving method of an interleaved polarity inversion point circuit. The data driving method includes:

Step 1: transmitting a charge sharing signal for the current data line according to a pre-stored charge sharing timing table;

see FIG. 5, FIG. 5 is a schematic structural view of another charge sharing switch. The charge sharing switch is mainly directed to an interleaved polarity inversion structure, and a charge sharing switch structure in which eight rows of data lines are one basic cycle unit is exemplarily shown in FIG. 5. For the polarity inversion structure, the charge sharing timing table includes control information of eight charge sharing switches, which can be stored and read by three bits. For example, you can use 000 to represent 8 charge sharing switches, 001 to open the first switch, and the rest to open. As in the first embodiment, the preset three bit charge sharing data is stored in the charge sharing timing table;

Step 2: transmitting a valid display data for the current data line; and

Step 3: executing the charge sharing signal to complete a charge sharing between signal channels.

Steps 2 and 3 of this embodiment are the same as S2 and S3 in the first embodiment, and are not described herein again.

In addition, in this embodiment, before step 1, the method further includes:

transmitting a polarity inversion signal for the current data line.

Figure 6:
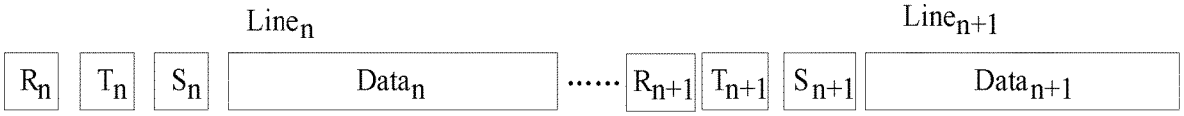
FIG. 6 is a timing diagram of another control signal according to an embodiment of the disclosure.

Specifically, see FIG. 6, FIG. 6 is a timing diagram of another control signal according to an embodiment of the disclosure. As shown in FIG. 6, the reset signal $R_n$ is transmitted before the charge sharing signal $S_n$ of the current data line $Line_n$ is transmitted according to the pre-stored charge sharing timing table to reset all signals of the previous data line. After transmitting the charge sharing signal for the current data line according to the pre-stored charge sharing timing table, the valid display data of the current data line is transmitted to the source driver through the mini LVDS differential interface and temporarily stored in the source driver. After transmitting the charge sharing signal $S_n$ for the current data line $Line_n$ according to the pre-stored charge sharing timing table, the valid display data $Data_n$ of the current data line is transmitted to the source driver through the mini LVDS differential interface and temporarily stored in the source driver. A polarity inversion signal $T_n$ is transmitted between the reset signal $R_n$ and the charge sharing signal $S_n$ to control polarity inversion between the respective data lines. When the polarity of the voltage on the current data line is inverted, the source driver controls the charge sharing switch according to the charge sharing signal $S_n$.

After all the data transmission of $Line_n$ is completed, after a certain field blanking area, the data information of the next data line $Line_{n+1}$ is repeatedly transmitted. Specifically, the reset signal $R_{n+1}$ is first transmitted to the source driver through the mini LVDS differential interface, and the reset signal $R_{n+1}$ is used to reset all signals of the data line $Line_n$, including resetting the charge sharing switch; the polarity inversion signal $T_{n+1}$ is transmitted to the source driver through the mini LVDS differential interface; the charge sharing signal $S_{n+1}$ is then transmitted to the source driver through the mini LVDS differential interface; the valid display signal $Data_{n+1}$ is transmitted to the source driver through the mini LVDS differential interface, and after the transmission of the valid display signal $Data_{n+1}$ is completed, a charge sharing command is executed to control the charge sharing switch. The transmission process is repeated until all information transmission of each data line in the current frame ends, and the source driver controls the display panel to perform screen display according to the valid display data of all the data lines.

The data driving method of this embodiment can separately set a charge sharing signal for each row by setting a charge sharing signal on the timing control before setting the valid display data in each row through the pre-stored charge sharing timing table. This achieves independent control of charge sharing per line during display.

In addition, the polarity inversion signal of the embodiment can also be transmitted by using a differential signal of the mini LVDS interface, instead of a plurality of pins for transmitting polarity inversion quotation marks disposed on the printed circuit board. Thereby the layout area of the printed circuit board is further reduced.

Embodiment 3

Figure 7:
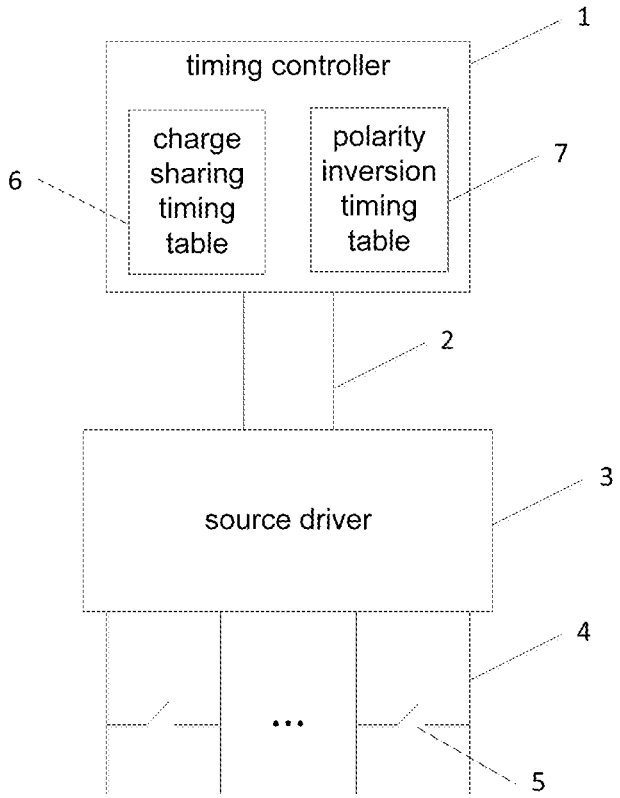
FIG. 7 is a schematic structural diagram of a data driving device according to an embodiment of the disclosure.

On the basis of the foregoing embodiments, the present embodiment provides a data driving device. Referring to FIG. 7, FIG. 7 is a schematic structural diagram of a data driving device according to an embodiment of the disclosure. The data driving device of this embodiment includes a timing controller 1, a transmission interface 2, a source driver 3, a plurality of data lines 4, and charge sharing switches 5, wherein the timing controller 1 is configured to store a plurality of valid display data and a plurality of charge sharing instructions; the transmission interface 2 is configured to transmit the plurality of valid display data and the plurality of charge sharing instructions to the source driver 3; the plurality of data lines 4 are configured to transmit the plurality of valid display data to respective pixel units of the display panel; the source driver 3 is configured to control the display panel to display an image according to the plurality of valid display data, and configured to control ON-OFF states of the charge sharing switch 5 according to the plurality of charge sharing instructions; and the charge sharing switches 5 each are connected to designated ones of the plurality of data lines, and configured to be turned on or off according to the plurality of charge sharing instructions to carry out a charge sharing between the designated ones of the plurality of data lines.

Further, the timing controller 1 is provided with a charge sharing timing table 6 for setting and storing the plurality of charge sharing instructions.

Further, the transmission interface 2 performs transmission of the valid display data and the charge sharing instruction according to the mini LVDS protocol.

Further, the timing controller 1 is further provided with a polarity inversion timing table 7 for setting a polarity inversion signal; and the polarity inversion signal is transmitted to the source driver 3 through the transmission interface 2.

The data driving device in this embodiment can perform the data driving methods in the first embodiment and the second embodiment, and the specific process is not described again.

The data driving device of this embodiment can separately set a charge sharing signal for each row by setting a charge sharing signal on the timing control before each row of valid display data through a pre-stored charge sharing timing table. This achieves independent control of charge sharing per line during display.

In addition, the polarity inversion signal of the embodiment can also be transmitted by using a differential signal of the mini LVDS interface, instead of a plurality of pins for transmitting polarity inversion quotation marks disposed on the printed circuit board. Thereby the layout area of the printed circuit board is further reduced.

The above is a further detailed description of the disclosure in connection with the specific preferred embodiments, and the specific embodiments of the disclosure are not limited to the description. It will be apparent to those skilled in the art that the disclosure may be made without departing from the spirit and scope of the disclosure.

What is claimed is:

1. A data driving method, comprising:

transmitting a charge sharing signal for a current data line according to a pre-stored charge sharing timing table;

transmitting a valid display data for the current data line; and executing the charge sharing signal to complete a charge sharing between signal channels;

wherein before transmitting a charge sharing signal for a current data line according to a pre-stored charge sharing timing table, the data driving method further comprises:

transmitting a reset signal to reset all signals for a previous data line;

wherein the transmitting a reset signal to reset all signals for a previous data line comprises:

transmitting the reset signal to a source driver through a mini LVDS differential interface, after the valid display data is executed;

storing the valid display data for the current data line according to the reset signal; and resetting a corresponding charge sharing switch according to the reset signal.

2. The data driving method according to claim 1, wherein before transmitting a charge sharing signal for a current data line according to a pre-stored charge sharing timing table, the data driving method further comprises:

transmitting a polarity inversion signal for the current data line.

3. The data driving method according to claim 1, wherein the transmitting a charge sharing signal for a current data line according to a pre-stored charge sharing timing table comprises:

reading the charge sharing signal for the current data line from the charge sharing timing table; and transmitting the charge sharing signal to the source driver through the mini LVDS differential interface.

4. The data driving method according to claim 3, wherein the transmitting a valid display data for the current data line comprises:

transmitting the valid display data to the source driver through the mini LVDS differential interface; and transmitting the valid display data to a display panel through the source driver.

5. The data driving method according to claim 1, wherein the executing the charge sharing signal to complete a charge sharing between signal channels comprises:

turning on or off a corresponding charge sharing switch according to the charge sharing signal, before the valid display data being switched in polarity between positive and negative polarities.

* * * * *